US005582948A

United States Patent [19]

Ashiya

[11] Patent Number: 5,582,948

[45] Date of Patent: Dec. 10, 1996

[54] PROCESS FOR PRODUCING ELECTROPHOTOGRAPHIC PHOTORECEPTOR

[75] Inventor: Seiji Ashiya, Minami-ashigara, Japan

[73] Assignee: Fuji Xerox Co., Ltd., Tokyo, Japan

[21] Appl. No.: 406,702

[22] Filed: Mar. 20, 1995

[30] Foreign Application Priority Data

Mar. 22, 1994 [JP] Japan ..... 6-073747

[51] Int. Cl.[6] ..... G03G 5/14

[52] U.S. Cl. ..... 430/131

[58] Field of Search ..... 430/60, 62, 64, 430/131

[56] References Cited

U.S. PATENT DOCUMENTS 5,188,916 2/1993 Hodumi et al. ..... 430/60

5,286,591 2/1994 Hongo ..... 430/60

FOREIGN PATENT DOCUMENTS 59-223439 12/1984 Japan .

61-94057 5/1986 Japan .

62-273549 11/1987 Japan .

*Primary Examiner*—John Goodrow

*Attorney, Agent, or Firm*—Oliff & Berridge

[57] ABSTRACT

A process for producing an electrophotographic photoreceptor comprising a conductive substrate having thereon an underlayer and further thereon a photoconductive layer, the process comprising the steps of: applying a coating composition comprising at least one of a zirconium alkoxide, a zirconium chelate compound, and a silane coupling agent on a conductive substrate; drying it to form an underlayer; atomizing a mixed solution comprising a water-compatible organic solvent and water to bring it into contact with the underlayer; and forming a photoconductive layer on the underlayer.

5 Claims, 2 Drawing Sheets

PROCESS FOR PRODUCING ELECTROPHOTOGRAPHIC PHOTORECEPTOR

FIELD OF THE INVENTION

The present invention relates to a process for producing an electrophotographic photoreceptor comprising of a conductive substrate, an underlayer, and a photoconductive layer, and more particularly to a process for producing an electrophotographic photoreceptor having an improved underlayer.

BACKGROUND OF THE INVENTION

Electrophotographic copying machines show a yearly increase in copying speed, and machines on which various sizes of paper can be copied have been developed. With such development, high-sensitive and long-lived photoreceptors have been desired so as to be able to comply therewith.

Recently, many function separation type electrophotographic photoreceptors, in which the photoreceptor functions are assigned to a plurality of members, have been proposed to improve electrophotographic characteristics such as charge keeping characteristics, repetition stability, light response, spectral characteristics, and mechanical strength.

These electrophotographic photoreceptors are known to have the following disadvantages:

(1) They are short of repetition stability of development contrast and environmental stability;

(2) Image defects called white spots, black spots, roughening, and pin holes are liable to be developed; and (3) The adhesive strength between the substrates and the photoconductive layers is low, and therefore, the photoreceptive layers are separated at the time of use to result in insufficient durability.

In order to solve these problems, attempts have been made to provide resin layers between the substrates and the photoconductive layers. Examples of the resins which are known to be used include polyparaxylene, casein, polyvinyl alcohol, phenyl resins, polyvinyl acetal resins, melamine resins, nitrocellulose, ethylene-acrylic acid copolymers, polyamides (such as nylon 6, nylon 66, nylon 610, copolymerized nylon and alkoxymethylated nylon), polyurethanes, gelatin, polyvinylpyrrolidone, polyvinylpyridine, and polyvinylmethyl ether.

Further, it has also been variously proposed to form intermediate layers using organic zirconium compounds such as zirconium chelate compounds and zirconium alkoxides and silane coupling agents, as described, e.g., in JP-A-59-223439 (the term "JP-A" as used herein means an "unexamined published Japanese patent application"), JP-A-61-94057, and JP-A-62-273549.

When the resin layer is provided as an underlayer, it mainly comprises a resin having a relatively large amount of polar groups, thereby controlling the volume resistivity to the extent that the electrophotographic characteristics are not deteriorated. However, the volume resistivity of the resin depends on the ion conductivity in many cases, so that it is significantly affected by temperature and humidity. Accordingly, when the photoreceptor is placed under the circumstances of low temperature and humidity or high temperature and humidity, the resin layer is markedly increased in resistivity to cause deterioration of the electrophotographic characteristics of the photoconductive layer, or the resin layer is significantly lowered in resistivity to cause the desired function of the resin layer to disappear.

According to the known resin layers, therefore, the drawbacks of the photoreceptors are only partly improved, or the effect is reduced by half, with the consideration of environmental characteristics, etc. Accordingly, they are technically very insufficient.

On the other hand, use of an organic zirconium compounds or a silane coupling agents fairly improves the above-described problems. However, the problem arises that a decrease in development contrast is induced associated with an increase in residual potential. Furthermore, for example, use of the zirconium chelate compounds causes insufficient curing reactivity, and use of the zirconium alkoxides or the silane coupling agents results in aging instability of coating solutions due to hydrolysis or aging instability in forming coated films. Thus, the organic zirconium compounds and the silane coupling agents are not necessarily satisfactory because of their drawbacks in preparing the underlayers.

As described above, the underlayers proposed in the prior art are not sufficient yet to remove various problems of the electrophotographic photoreceptors, which causes unsatisfactory characteristics of the photoreceptors.

SUMMARY OF THE INVENTION

An object of the present invention is to provide a process for producing an electrophotographic photoreceptor which is low in dark decay, excellent in charge characteristics, difficult to be decreased in development contrast, and particularly low in residual potential.

Another object of the present invention is to provide a process for producing an electrophotographic photoreceptor in which image defects such as white spots, black spots, roughening, and pin holes are difficult to be developed.

A further object of the present invention is to provide a process for producing an electrophotographic photoreceptor having electrophotographic characteristics narrow in environmental fluctuations and excellent in durability.

A still further object of the present invention is to provide a process for producing an electrophotographic photoreceptor having an underlayer improved in curing reactivity which is necessary for formation of a coated film and in aging stability of a coating composition depending on instability due to hydrolysis.

Other objects and effects of the present invention will be apparent from the following description.

As a result of studies, the present inventors have found that the above-described objects are attained by forming an underlayer by using a specific organic metal compound, and treating the underlayer with an aqueous solution of a hydrophilic organic solvent, thus completing the present invention.

The present invention relates to a process for producing an electrophotographic photoreceptor comprising a conductive substrate having thereon an underlayer and further thereon a photoconductive layer, the process comprising the steps of:

applying a coating composition comprising at least one of a zirconium alkoxide, a zirconium chelate compound, and a silane coupling agent on a conductive substrate;

drying it to form an underlayer;

atomizing a mixed solution comprising a water-compatible organic solvent and water to bring it into contact with the underlayer; and forming a photoconductive layer on said underlayer.

DETAILED DESCRIPTION OF THE INVENTION

Figure 1:
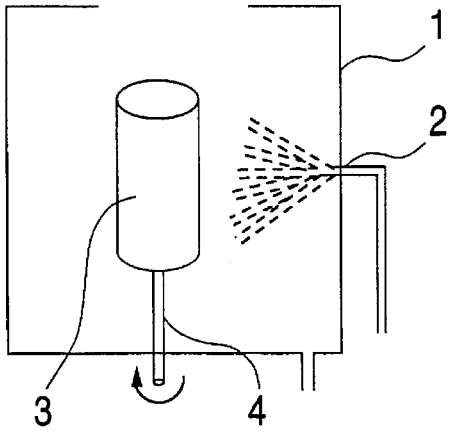
FIG. 1 is a schematic view showing an embodiment of an underlayer treating apparatus used in the present invention.

In the present invention, a coating composition containing a zirconium alkoxide, a zirconium chelate compound or a silane coupling agent is applied to the surface of a conductive substrate, and dried. The zirconium alkoxide, the zirconium chelate compound or the silane coupling agent is then hydrolyzed to form a coated film of a polymerized product thereby forming an underlayer.

There is no particular limitation on the conductive substrate. Any substrate can be used as long as it is used in electrophotographic photoreceptors.

Examples of the zirconium alkoxides and the zirconium chelate compounds contained in the coating compositions for the underlayer include zirconium tetrabutoxide ($Zr(OC_4H_9)_4$), zirconium tetraacetylacetonate ($Zr(C_5H_7O_2)_4$), acetylacetonatozirconium tributoxide ($(C_5H_7O_2)Zr(OC_4H_9)_3$), tetrakis(dipivaloylmetanite)zirconium (IV) ($Zr(C_{11}H_{19}O_2)_4$), and zirconium tetraisopropoxide ($Zr(OC_3H_7)_4$). Among these, zirconium tetrabutoxide ($Zr(OC_4H_9)_4$) and zirconium tetraacetylacetonate ($Zr(C_5H_7O_2)_4$) are preferred.

Examples of the silane coupling agents include vinyltrichlorosilane, vinyltrimethoxysilane, vinyltriethoxysilane, vinyltris-2-methoxyethoxysilane, vinyltriacetoxysilane, γ-glycidoxypropyltrimethoxysilane, γ-methacryloxypropyltrimethoxysilane, γ-aminopropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane and β-3,4-epoxycyclohexylethyltrimethoxysilane. Among these, γ-aminopropyltrimethoxysilane and γ-chloropropyltrimethoxysilane are preferred.

In the present invention, the above-described zirconium alkoxides, zirconium chelate compounds and silane coupling agents may be used alone or as a mixture of two or more kinds of them if necessary. When they are used as a mixture, the mixing ratio of them can be appropriately established.

In order to prepare the coating compositions for forming the underlayers, solvents for solving the above-described zirconium alkoxides, zirconium chelate compounds and silane coupling agents are used. Examples of such solvents which can be used alone or as a mixture thereof include alcohols such as ethanol, methanol, propanol and butanol, aromatic hydrocarbons such as toluene, and esters such as ethyl acetate.

For coating the coating compositions on the conductive supports, various coating methods can be used, such as dip coating, spray coating, blade coating, spinner coating, bead coating, and curtain coating. Drying can preferably be conducted at a temperature of 10° to 250° C., more preferably 100° to 180° C., for 5 minutes to 5 hours, more preferably 10 minutes to 2 hours, by ventilation drying or standstill drying.

In the present invention, the thickness of the underlayer is generally 0.01 to 5 μm, and preferably 0.2 to 2 μm.

Prior to formation of a photoconductive layer, a mixed solution of a water-compatible organic solvent and water is atomized and brought into contact with the underlayer formed by coating and drying as described above.

Examples of the water-compatible organic solvents which are mixed with water include alcohols such as methanol, ethanol, 1-propanol, isopropyl alcohol, t-butyl alcohol and allyl alcohol; glycols such as ethylene glycol, propylene glycol and glycerol; ethers such as tetrahydrofuran and 1,4-dioxane; ketones such as acetone; amines such as propylamine, butylamine, cyclohexylamine, arylamine, ethylenediamine, ethyleneimine and pyridine; ether alcohols such as methyl cellosolve, cellosolve, methyl carbitol and ethylene glycol ether; and ethers such as dimethyl cellosolve and diethylene glycol dimethyl ether. Among these, solvents having higher solubility in water are preferred, and those capable of being mixed with water in any ratio are particularly preferred. Specifically, alcohols and glycols are preferred, and alcohols having 1 to 4 carbon atoms are particularly preferred.

In the mixed solution of the water-compatible organic solvent and water, the water contained in the solution largely contributes to hydrolysis. It is therefore preferred that the content of the organic solvent in the mixed solution is preferably less than 50% by weight. If the content of the organic solvent is lower than the above-described range, the penetrating speed of water into the coated film tends to be decreased, resulting in non-uniform penetration.

A surface active agent is preferably added to the mixed solution of the water-compatible organic solvent and water, from the viewpoint of promotion of water penetration and a reduction in defects of the coated film (underlayer). As the surface active agents, known commercial products can be used. Examples thereof include ionic surface active agents such as soap, sodium alkylbenzenesulfonates, sodium alkanesulfonates, sodium α-olefinsulfonates, sodium salts of α-sulfofatty acid methyl esters, sodium salts of alkyl sulfates, sodium salts of alkyl phosphates, sodium salts of N-acylamino acids, dialkyldimethylammonium chlorides and monoalkyltrimethylammonium chlorides; nonionic surface active agents such as straight chain alkyl polyoxyethylene ethers, S-alkyl polyoxyethylene ethers, alkylphenyl polyoxyethylene ethers, N,N-di(alkanol)alkaneamides and N-dimethyl-N-dodecylamine oxide; and amphoteric surface active agents such as sulfobetaines and betaines. Among these, sodium alkylbenzenesulfonates and sodium alkanesulfonates are preferred. The content of the surface active agent in the mixed solution is generally 10% by weight or less, preferably 5% by weight or less, and more preferably 1% by weight or less.

The mixed solutions of the water-compatible organic solvents and water can be atomized by known methods. For example, they may be atomized by use of means such as spraying, ultrasonic oscillation and boiling by heating. Atomization at a liquid temperature of 50° C. or more, preferably from 50° to 95° C., advantageously promotes penetration into the coated films of the underlayers and causes rapid drying after treatment.

In the present invention, the atomized mixed solution should be in contact with the underlayer in such a manner that the surface of the underlayer is uniformly wetted with the mixed solution. If the underlayer is wetted non-uniformly, it is not preferred since the underlayer is hardened non-uniformly. It is a preferred state of wetting the underlayer that droplets of the atomized mixed solution adhered on the surface of the underlayer cannot be distinguished from each other by the naked eye.

FIGS. 1 to 4 are schematic views showing examples of apparatuses for atomizing the mixed solutions of the water-compatible organic solvents and water, and bringing them into contact with the surfaces of the underlayers. The present invention is not construed as being limited to these apparatuses.

Referring to FIG. 1, an air spray gun 2 is fitted to a side wall of a housing 1, and a conductive substrate 3 on which an underlayer is formed is freely rotatably supported by a rotary shaft 4. In this apparatus, the rotary shaft 4 is driven for rotation in the direction indicated by the arrow to rotate the conductive substrate 3, with the above-described mixed solution being sprayed from the air spray gun 2 to the underlayer.

Figure 2:
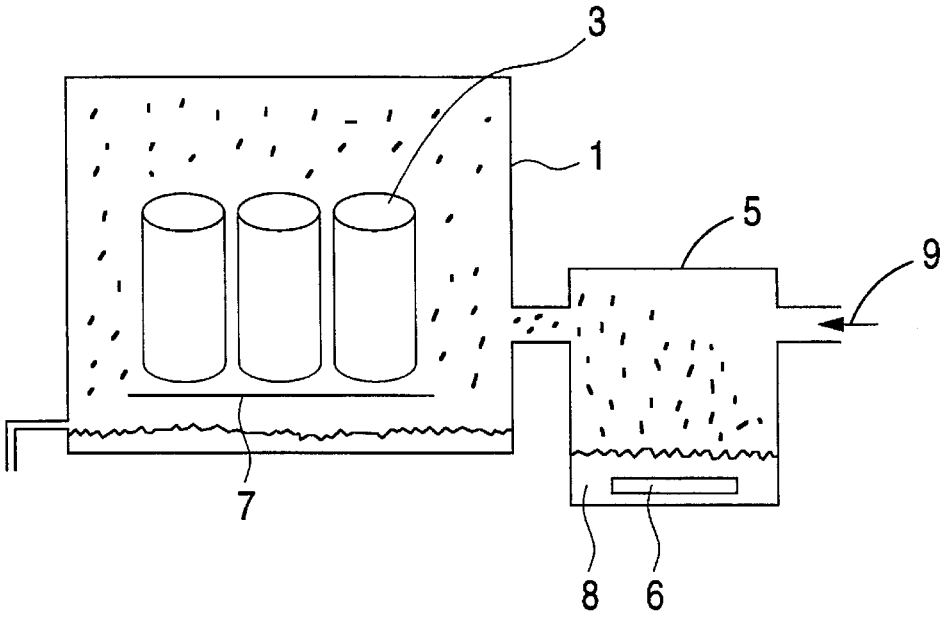
FIG. 2 is a schematic view showing another embodiment of an underlayer treating apparatus used in the present invention.

Referring to FIG. 2, an atomizing device 5 equipped with an ultrasonic oscillator 6 is connected to a closed housing 1. In this apparatus, a conductive substrate on which an underlayer is formed is placed on a supporting table 7 in the housing 1. The mixed solution 8 placed in the atomizing device 5 is atomized by the ultrasonic oscillator 6, and the atomized mixed solution is sent into the closed housing 1 by means of an air flow 9 to bring it into contact with the surface of the underlayer therein.

Figure 3:
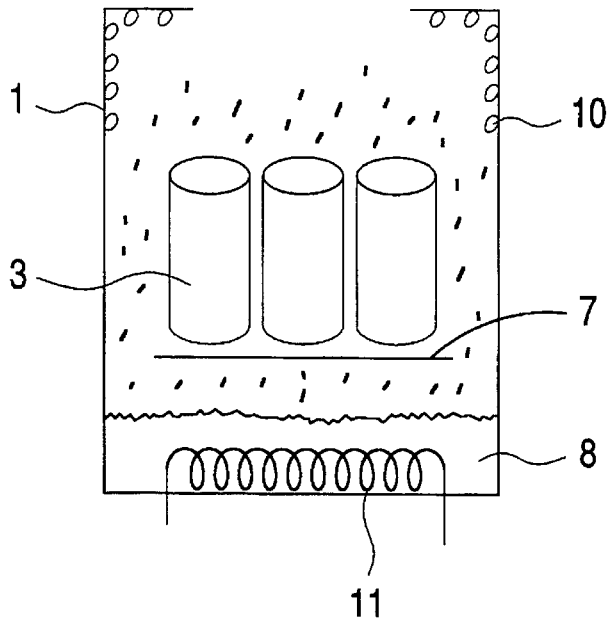
FIG. 3 is a schematic view showing a further embodiment of an underlayer treating apparatus used in the present invention.

Referring to FIG. 3, a cooler 10 is mounted on an upper portion of a housing 1, a top of which is opened, and a heater 11 mounted on a bottom portion thereof. In this apparatus, the mixed solution 8 is placed in the housing 1, and a conductive substrate 3 with an underlayer formed thereon is placed on a supporting table 7. The mixed solution is boiled by heating with the heater 11, and atomized to bring it into contact with the underlayer.

Figure 4:
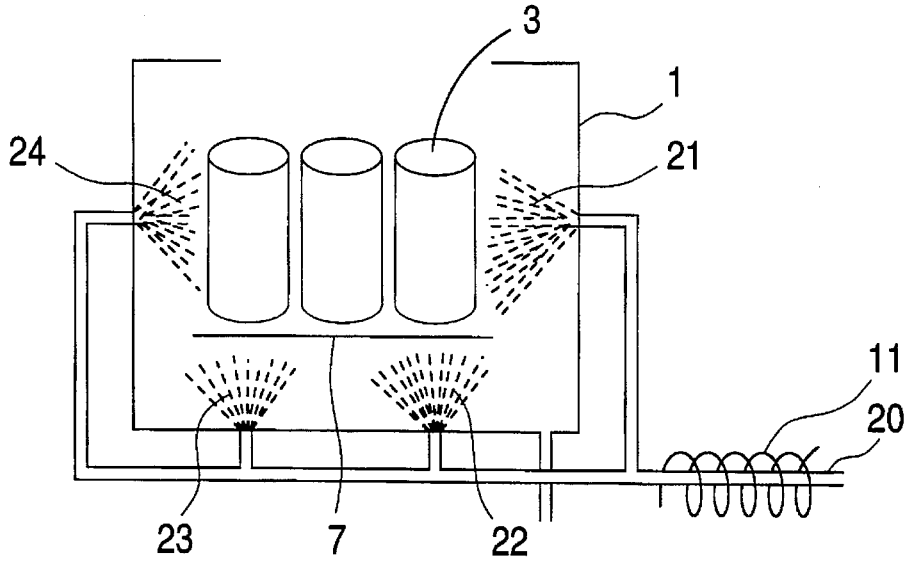
FIG. 4 is a schematic view showing still another embodiment of an underlayer treating apparatus used in the present invention.

Referring to FIG. 4, air spray guns 21, 22, 23 and 24 connected to a conduit pipe 20 provided with a heater 11 are arranged at plural portions of a housing 1. In this apparatus, the mixed solution heated with the heater 11 is sprayed from the plural air spray guns to a conductive substrate with an underlayer formed thereon placed on a supporting table 7 to bring it into contact with the underlayer.

The underlayer is brought into contact with the atomized mixed solution as described above, followed by drying. Drying may be conducted either at ordinary temperature or by heating.

A photoconductive layer is formed on the underlayer treated as described above. The photoconductive layer may be of a single layer structure or a laminated structure. The photoconductive layer is formed in the form that at least a charge generating material is dispersed therein.

The photoconductive layers of the single layer structure include dye-sensitized ZnO photoconductive layers, CdS photoconductive layers, and photoconductive layers in which charge generating materials are dispersed in charge transporting materials and binder resins.

The photoconductive layers of the laminated structure include layers in which functions are separately assigned to a charge generating layer and a charge transporting layer. For the order of lamination of the charge generating layer and the charge transporting layer on the conductive substrate, either may be a lower layer.

In general, the charge generating layer is formed by applying a dispersion in which the charge generating material is dispersed in a solution of the binder resin in a solvent. Examples of the charge generating materials include selenium and selenium alloys such as CdSe and CdSSe, inorganic photoconductors such as CdS, ZnO and ZnS, metallic or nonmetallic phthalocyanine pigments, azo pigments such as biszao pigments and trisazo pigments, squalium compounds, azulenium compounds, perylene pigments, indigo pigments, quinacridone pigments, polycyclic quinone pigments, cyanine dyes, xanthene dyes, charge transfer complexes composed of poly-N-vinylcarbazole, trinitrofluorenone, etc., and eutectic complexes composed of pyrylium salt dyes and polycarbonate resins.

Examples of the binder resins include known resins such as polycarbonates, polystyrene, polyesters, polyvinyl butyral, methacrylate polymers or copolymers, vinyl acetate polymers or copolymers, cellulose esters or ethers, polybutadiene, polyurethanes and epoxy resins.

The charge transporting layer is generally formed by applying a coating solution in which the charge transporting material is dissolved in a solution of the binder resin in a solvent. There is no particular limitation on the charge transporting material, as long as it is transparent to visible light and has a charge transporting function. Examples thereof include imidazole, pyrazoline, thiazole, oxadiazole, oxazole, hydrazone, ketazine, azine, carbazole, polyvinylcarbazole, and derivatives thereof; triphenylamine derivatives; stilbene derivatives; and benzine derivatives. A binder resin may be used in combination as required. Examples of the binder resins include polycarbonates, polyarylates, polyesters, polystyrene, styrene-acrylonitrile copolymers, polysulfones, polymethacrylates, and styrene-methacrylate copolymers.

The reason why the mixed solution of the water-compatible organic solvent and water is atomized to bring it into contact with the underlayer in the present invention is described below.

When the coating composition for forming the underlayer is applied and dried, the zirconium alkoxide, the zirconium chelate compound or the silane coupling agent contained in the coated film (underlayer) is hydrolyzed to polymerize, resulting formation of a coated film composed of a polymerized product. The hydrolysis reaction, for example, in the case of the zirconium alkoxide, proceeds as follows:

$$Zr(OR)_4 + H_2O \longrightarrow Zr(OR)_3OH + ROH$$

$$Zr(OR)_3OH + Zr(OR)_4 \longrightarrow Zr(OR)_3-O-Zr(OR)_3 + ROH$$

$$Zr(OR)_3-O-Zr(OR)_3 + Zr(OR)_3OH \longrightarrow Zr(OR)_3 \left[ O-Zr(OR)_2 \right]_n OZr(OR)_3$$

$$n(OR)_3Zr-O-Zr(OR)_3 + nH_2O \longrightarrow \left[ Zr(OR)_2 \right]_{2n} + 2nROH$$

-continued

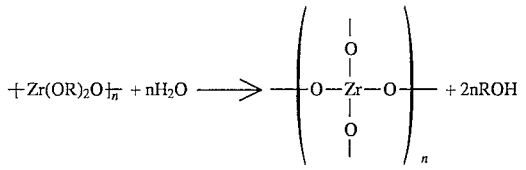

The zirconium chelate compound and the silane coupling agent are considered to be also hydrolyzed in a manner similar to that described above to form the network-like polymerized product.

The existence of water largely contributes to this hydrolysis reaction. When coating and drying are performed according to the conventional methods, water required for hydrolysis is supplied from a slight amount of moisture dissolved in the coating composition or by contact with moisture in the air after formation of the coated film. In the underlayer formed as described above, the hydrolysis of the zirconium alkoxide, the zirconium chelate compound or the silane coupling agent does not sufficiently proceed only by coating of the coating composition and drying, and the resulting polymerized product is not necessarily in a chemical-structurally stable state.

When the mixed solution of the water-compatible organic solvent and water is atomized and brought into contact with the underlayer formed as described above, water required for the hydrolysis is supplied in excess from the outside of the coated film to promote the hydrolysis of the zirconium alkoxide, the zirconium chelate compound or the silane coupling agent, which causes sufficient hydrolysis. As a result, the underlayer of a chemically stable polymerized product is formed. In the present invention, the mixed solution of the water-compatible organic solvent and water is used, so that the penetrating rate of water into the coated film can be high and it becomes possible to allow water to uniformly penetrate the entire coated film, compared with the case of using water alone. In addition, generation of coated film defects caused by drying unevenness, solution stains, solution cissing, etc. in the drying step after contact treatment can be prevented.

The present invention will be illustrated in greater detail with reference to the following examples, but it should be understood that the present invention is not deemed to be limited thereto. All parts are by weight, unless otherwise indicated.

EXAMPLE 1

The following components were stirred with a stirrer to prepare a coating composition for forming an underlayer.

| | |
|---|---|
| Solution of Tributoxyzirconium Acetylacetonate in Toluene (ZC540, manufactured by Matsumoto Kosho Co.) (tributoxyzirconium acetylacetonate/toluene = 1/1 (by weight)) | 100 parts |
| γ-Aminopropyltrimethoxysilane ($H_2NC_3H_6Si(OCH_3)_3$) (A1110, manufactured by Nippon Unicar Co., Ltd.) | 11 parts |
| Ethyl Alcohol | 600 parts |
| n-Butyl Alcohol | 150 parts |

This coating composition was applied on an aluminum pipe by dip coating, and dried by heating at 100° C. for 5 minutes to form an underlayer having a thickness of 0.2 μm.

A mixed solution of 400 parts of ethanol and 600 parts of water was prepared. This mixed solution was atomized with an air spray at room temperature, and uniformly sprayed to a surface of the above-described underlayer. After air drying, it was dried by heating at 80° C. for 5 minutes.

1 part of chlorogallium phthalocyanine crystals was mixed with 1 part of a vinyl chloride-vinyl acetate copolymer resin (VMCH, manufactured by Union Carbide Co.) and 100 parts of n-butyl acetate, and the mixture was treated together with glass beads in a paint shaker for 1 hour to disperse. The resulting coating solution was applied on the aluminum pipe on which the above-described underlayer had been formed, by dip coating, and dried by heating at 100° C. for 10 minutes to form a charge generating layer having a thickness of 0.15 μm.

50 parts of polycarbonate Z (weight average molecular weight MW: 110,000, manufactured by Mitsubishi Gas Chemical Co., Inc.) having repeating structural units represented by the following structural formula:

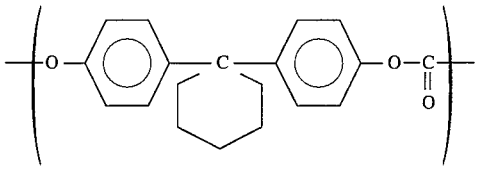

and 50 parts of N,N-bis(3,4-dimethylphenyl)biphenyl-4-amine were dissolved in 300 parts of tetrahydrofuran. The resulting coating solution was applied on the aluminum pipe on which the charge generating layer had been formed, by dip coating, and dried by heating at 120° C. for 1 hour to form a charge transporting layer having a thickness of 20 μm.

The electrophotographic photoreceptor thus obtained was treated according to the steps (A), (B), and (C): (A) The photoreceptor was charged with a scorotron charger having a grid applied voltage of −700 V by use of a laser printer modified scanner (a modified XP-11 machine, manufactured by Fuji Xerox Co., Ltd.) under the circumstances of low temperature and humidity (10° C., 15% RH). (B) After 1 second, the photoreceptor was irradiated with light of 5 ergs/cm$^2$ by use of a semiconductor laser of 780 nm to conduct exposure. (C) After further 3 seconds, the photoreceptor was irradiated with red LED light of 50 ergs/cm$^2$ to conduct discharge. The potential in each process was measured. After repeated charge of 5,000 cycles, the potential was also measured. Further, the photoreceptor was also charged under the circumstances of high temperature and humidity (28° C., 85% RH), and the fluctuated amount of each potential was measured to evaluate environmental stability. Results thereof are shown in Table 1.

EXAMPLE 2

An underlayer was formed in the same manner as with Example 1 with the exception that γ-aminopropyltrimethoxysilane was not used in the components of the coating composition for the underlayer of Example 1.

A mixed solution of 450 parts of methanol, 550 parts of water and 0.5 part of a surface active agent, sodium alkylbenzenesulfonate, was prepared. This mixed solution was kept at a solution temperature of 60° C., and atomized with an air spray to uniformly spray it on the entire surface of the underlayer. After air drying, it was dried by heating at 80° C. for 5 minutes.

Subsequently, a charge generating layer and a charge transporting layer were formed in the same manner as with Example 1 to prepare an electrophotographic photoreceptor.

For the resulting electrophotographic photoreceptor, evaluation was made in the same manner as with Example 1. Results obtained are shown in Table 1.

EXAMPLE 3

An underlayer was formed in the same manner as with Example 1 with the exception that γ-aminopropyltrimethoxysilane was not used in the components of the coating composition for the underlayer of Example 1.

A mixed solution of 200 parts of acetone and 800 parts of water was prepared. This mixed solution was atomized with an air spray at room temperature to uniformly spray it on the entire surface of the underlayer. After air drying, it was dried by heating at 80° C. for 5 minutes.

Subsequently, a charge generating layer and a charge transporting layer were formed in the same manner as with Example 1 to prepare an electrophotographic photoreceptor. For the resulting electrophotographic photoreceptor, evaluation was made in the same manner as with Example 1. Results obtained are shown in Table 1.

COMPARATIVE EXAMPLE 1

An electrophotographic photoreceptor was prepared in the same manner as with Example 1 with the exception that the mixed solution of ethanol and water was not sprayed after formation of the underlayer, and evaluation was similarly made. Results obtained are shown in Table 1.

COMPARATIVE EXAMPLE 2

An underlayer was formed in the same manner as with Example 1 with the exception that γ-aminopropyltrimethoxysilane was not used in the components of the coating composition for the underlayer of Example 1.

Water was atomized with an air spray at room temperature to uniformly spray it on the entire surface of the underlayer. After air drying, it was dried by heating at 80° C. for 5 minutes.

Subsequently, a charge generating layer and a charge transporting layer were formed in the same manner as with Example 1 to prepare an electrophotographic photoreceptor. For the resulting electrophotographic photoreceptor, evaluation was made in the same manner as with Example 1. Results obtained are shown in Table 1.

TABLE 1

| | Initial Characteristics (1 cycle) | | | Keeping Characteristics (5,000 cycles) | | | Environmental Stability | | | |
|---|---|---|---|---|---|---|---|---|---|---|
| | Potential (A) VH (V) | Potential (B) VL (V) | Potential (C) VRP (V) | Potential (A) VH (V) | Potential (B) VL (V) | Potential (C) VRP (V) | Fluctuated Amount of Potential ΔVH (V) | Fluctuated Amount of Potential ΔVL (V) | Fluctuated Amount of Potential ΔVRP (V) | Image Quality after 10,000 Prints |
| Example 1 | −680 | −120 | −10 | −690 | −140 | −30 | 0 | 5 | 5 | * |
| Example 2 | −700 | −120 | −10 | −690 | −150 | −40 | 10 | 5 | 0 | * |
| Example 3 | −690 | −130 | −10 | −690 | −150 | −40 | 5 | 5 | 10 | * |
| Example 4 | −690 | −120 | −5 | −690 | −140 | −30 | 5 | 5 | 10 | * |
| Comparative Example 1 | −670 | −120 | −20 | −690 | −190 | −80 | 5 | 10 | 10 | ** |
| Comparative Example 2 | −680 | −120 | −20 | −680 | −130 | −30 | 5 | 5 | 5 | *** |

*No image defects such as "white spots" and "black spots" were developed.
**Many image defects caused by black spots were developed.
***Many solution stain-like or uneven droplet-like image defects were developed.

EXAMPLE 4

100 parts of γ-aminopropyltrimethoxysilane was mixed with 8 parts of water, and the mixture was stirred with a stirrer for 3 hours, followed by addition of 600 parts of ethyl alcohol and 150 parts of n-butyl alcohol. The mixture was stirred with a stirrer to prepare a coating composition for forming an underlayer.

This coating composition was applied on an aluminum pipe by dip coating, and dried by heating at 100° C. for 5 minutes to form an underlayer having a thickness of 0.2 μm.

A mixed solution of 300 parts of ethanol, 700 parts of water and 0.5 part of a surface active agent, sodium alkylbenzenesulfonate, was prepared, and the mixed solution was atomized with an air spray to uniformly spray it on the entire surface of the underlayer. An electrophotographic photoreceptor was then prepared in the same manner as with Example 1. For the resulting electrophotographic photoreceptor, evaluation was made in the same manner as with Example 1. Results obtained are shown in Table 1.

In the present invention, as described above, the mixed solution of the water-compatible organic solvent and water is atomized and brought into contact with the underlayer formed by coating and drying. Accordingly, water penetrates the coated film rapidly and uniformly to promote the hydrolysis of the zirconium alkoxide, the zirconium chelate compound or the silane coupling agent, which causes sufficient hydrolysis. As a result, the underlayer of the chemically stable polymerized product is formed, so that the electrophotographic photoreceptors obtained according to the present invention have excellent electrophotographic characteristics.

While the invention has been described in detail and with reference to specific examples thereof, it will be apparent to one skilled in the art that various changes and modifications can be made therein without departing from the spirit and scope thereof.

What is claimed is:

1. A process for producing an electrophotographic photoreceptor comprising a conductive substrate having thereon an underlayer and further thereon a photoconductive layer, said process comprising the steps of:

applying a coating composition comprising at least one of a zirconium alkoxide, a zirconium chelate compound, and a silane coupling agent on a conductive substrate;

drying said coating composition to form an underlayer;

atomizing a mixed solution comprising a water-compatible organic solvent and water to promote uniform hydrolysis of said underlayer by bringing said mixed solution into contact with said underlayer; and forming a photoconductive layer on said underlayer.

2. A process as claimed in claim 1, wherein said water-compatible organic solvent is an alcohol.

3. A process as claimed in claim 1, wherein the content of said water-compatible organic solvent in said mixed solution is less than 50% by weight.

4. A process as claimed in claim 1, wherein said mixed solution further comprises a surface active agent.

5. A process as claimed in claim 1, wherein said mixed solution is atomized at a solution temperature of 50° C. or more.

* * * * *